United States Patent [19]

Steidinger

[11] 4,081,127

[45] Mar. 28, 1978

[54] RETURN ENVELOPE FOR MAILER AND METHOD

[75] Inventor: Donald J. Steidinger, Barrington, Ill.

[73] Assignee: Wallace Business Forms, Inc., Hillside, Ill.

[21] Appl. No.: 696,352

[22] Filed: Jun. 15, 1976

[51] Int. Cl.[2] ..... B65D 27/10

[52] U.S. Cl. ..... 229/69; 229/73

[58] Field of Search ..... 229/69, 73, 85

[56] References Cited

U.S. PATENT DOCUMENTS

| | | | |
|---|---|---|---|
| 1,952,972 | 3/1934 | Councilor | 229/73 X |
| 1,995,183 | 3/1935 | Kovnat | 229/73 |
| 2,044,541 | 6/1936 | Nigoul | 229/85 |
| 2,931,559 | 4/1960 | Hilliard | 229/73 |
| 3,152,751 | 10/1964 | Hiersteiner | 229/73 |
| 3,498,528 | 3/1970 | Klein | 229/73 |
| 3,512,702 | 5/1970 | Pritchard, Jr. | 229/73 |
| 3,554,438 | 1/1971 | Van Malderghem | 229/73 X |

*Primary Examiner*—Stephen P. Garbe

*Attorney, Agent, or Firm*—Tilton, Fallon, Lungmus & Chestnut

[57] ABSTRACT

A return envelope for a mailer and method wherein the return envelope has a flap united with the envelope front along a fold line and is equipped with an adhesive adjacent its free edge, the flap initially being positioned in face to face relation with the envelope front, the flap, after removal of the envelope from the mailer being foldable along a line of potential folding intermediate the original fold line and the free edge to create an envelope pocket capable of receiving a check or the like which is larger than the pocket normally developed by the cooperation of the envelope front and back.

9 Claims, 7 Drawing Figures

RETURN ENVELOPE FOR MAILER AND METHOD

BACKGROUND AND SUMMARY OF INVENTION

This invention relates to a return envelope for a mailer and, more particularly, to a return envelope especially suited for relatively small mailers. The type of mailer with which the instant invention is concerned can be seen in U.S. Pat. Nos. 3,104,799 and 3,777,971. These devices are more properly stuffed sealed envelope assemblies and have come into popular vogue in the last decade. Literally millions of these mailers are processed every year by stepping the same through computer printers so that invoicing information and the like can be applied to the interior of the mailer without the need for manual handling, stuffing, sealing, stamping, etc.

Conventionally, the mailers are provided in a continuous stream or series of connected stuffed sealed envelopes equipped with control margins along the longitudinally extending edges to manufacture and process the mailers. As the final stages of manufacture, the assemblies are zig-zag folded and delivered to a customer whose computer provides the various assemblies with the proper information. Over the years a variety of sizes of mailers, more particularly, mailers having different "lengths" have been produced. By the term "length" I refer to the dimension extending parallel to the path of travel, i.e., parallel to the control margins. Hence, it will be appreciated that the final envelope assembly or mailer may have a transverse dimension longer than the so-called "length" but it is with the "length" dimension which has created the problem of providing suitable return envelopes.

In mailers with short form lengths such as $3\frac{3}{8}$, 4, $4\frac{1}{4}$, etc., (under $5\frac{1}{2}$ inches generally), the return envelope that can be included within the mailer is too small for the user to conveniently insert a check. This condition is equally true for both side-open or top-open return envelopes. As a result, it is often necessary to sell a longer mailer form to a customer than would otherwise be necessary — in order to have room enough to include a satisfactory return envelope. This alternative results in a more costly mailer form, one that requires more computer time for processing — and mailers that are considerably larger than regular mail, which results in more abuse in their handling in the mails. For one thing, these stick up higher when included in a pack of regular mail. One alternative is to provide a mailer without a return envelope which results in a failure to meet the business system requirements.

The purpose of the instant invention is to provide a top opening return envelope (preferred by most people because of the ease of check insertion) within the mailer form that is large enough to conveniently accept the document to be returned, typically a check, and that can be fit into a space inside the outgoing mailer that is smaller than the desired size of the return envelope.

The object of the invention is accomplished by making the return envelope of a front and back ply both formed from continuous webs of paper (or the like) at the same time the mailer is being assembled. The return envelope is thus made "on line". The back ply is made as a conventional inside ply of the mailer but the front ply is longer than the normal inside plies but not longer than twice as long. The front ply is folded across the width of the web to provide a flap, the flap being larger than a normal envelope flap so as to be foldable along a line of potential folding between the free edge of the flap and the fold line so as to develop a return envelope having a significantly larger check-receiving pocket.

Other objects and advantages of the invention may be seen in the details of construction, operation and use as set forth in the ensuing specification.

The invention is described in conjunction with the accompanying drawing, in which FIG. 1 is a fragmentary perspective view in exploded form of a mailer utilizing the inventive return envelope;

Figure 1:
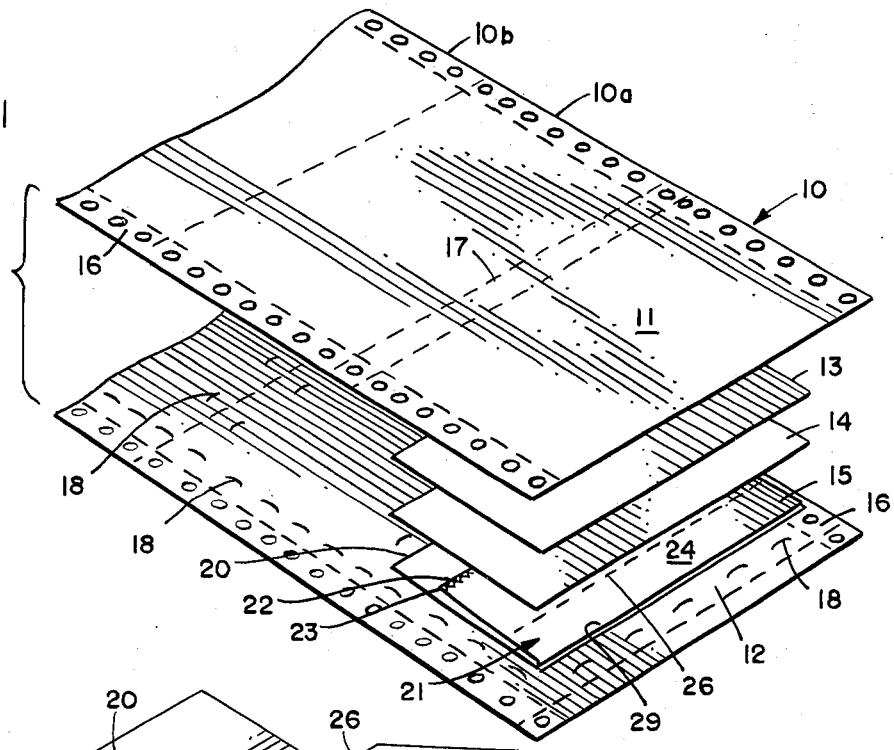

In the illustration given and with reference first to FIG. 1, the numeral 10 designates generally a mailer which is shown in exploded or expanded form. Inasmuch as the instant invention is concerned particularly with the return envelope, only the minimum features of a mailer are shown and described for the purpose of clarity of understanding. It will be appreciated that the mailers contain features and elements not shown and described herein but which are readily appreciated by those skilled in the art, particularly by reference to the above-mentioned U.S. Pat. Nos. 3,104,799 and 3,777,971 — and the disclosures thereof are incorporated herein by express reference.

Conventionally, the mailer 10 is provided as part of a connected series which includes other mailers **10*a*, 10*b*, etc. Each mailer 10, 10*a*, 10*b*, etc. includes a top ply 11 and a bottom ply 12 as well as a plurality of single intermediate plies 13, 14 and the plural plies 15**, which, as illustrated herein, constitute the return envelope.

As can be readily appreciated from a consideration of FIG. 1, the intermediate plies 13–15 are smaller than the top and bottom or outer plies 11 and 12 of the mailer 10. For example, it is conventional to provide the top and bottom plies 11 and 12 with control margins as at 16 which are equipped with line holes to facilitate manufacture and computer printer processing. After the relevant recipient information has been applied by the computer printer, the control margins 16 are removed and the various mailers or envelope assemblies are separated or "burst" along the perforation lines 17 to yield discrete individual stuffed sealed envelope assemblies. Thus, each mailer has lines of adhesive (not shown) or other uniting means along the four sides which define the mailer interior. It is within the interior that the intermediate plies 13–15 are located. For the purpose of maintaining the interior plies in proper register it is advantageous to use embossment means as at 18, further details of which can be seen in the above-mentioned U.S. Pat. No. 3,777,971.

Figure 2:
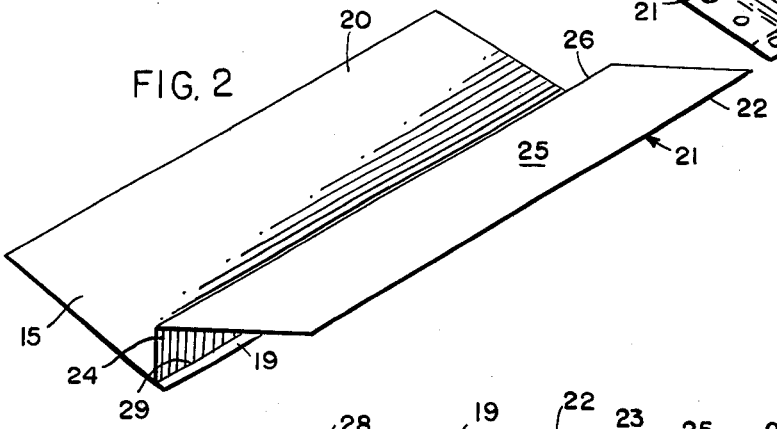
FIG. 2 is a perspective view of a single return envelope in the condition it assumes after removal from the mailer and just prior to being returned by the original recipient.

Referring now to FIG. 2, the return envelope 15 is seen in a partially unfolded state. It is seen to include a first ply portion 19 which constitutes the back of the return envelope (see also FIG. 4) and a second ply portion 20 which ultimately constitutes a portion of the front or face of the return envelope. A third ply portion 21 is also provided, advantageously as an extension of or integral with the second ply portion 20. The third ply portion 21 is essentially a flap portion having a free edge 22. Adjacent this free edge 22, the third flap portion 21 is equipped with adhesive as at 23 which conveniently can be of the remoistenable type well known in the art.

The third ply portion 21 ultimately constitutes the remaining part of the front flap (see the part designated 24) and the flap part 25 of the return envelope 15. These two parts 24 and 25 are separated by a line of potential folding 26 which can take a variety of forms. For example, the third ply portion 21 can be prescored (transversely of the "length" of the mailers). Other forms of weakening such as perforations can be employed or the third ply portion 21 can be equipped with a print line having associated therewith suitable indicia such as "fold along this line". In any event, the recipient of the mailer 10, after performing the operation depicted in FIG. 6, folds the third ply portion 21 along the line of potential folding 26 (see FIG. 7) so as to develop a return envelope capable of receiving a check or the like 27 (see FIG. 4) which is "longer" than the return envelope back 19.

Figure 3:
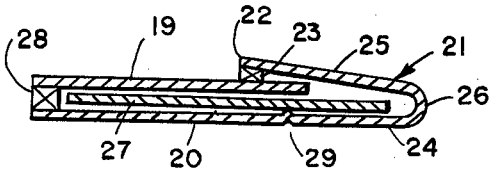
FIG. 3 is an enlarged sectional view showing the return envelope in its condition ready for return mailing.

In the manufacture of the return envelope, the various plies can be laid down during the formation of the mailer and prior to the perimetric union of the webs 11 and 12 about the plies 13–15. In the event the web forming the back or first ply portion 19 is separate from the web making up the second and third ply portions, a "U" pattern of adhesive is applied so as to secure the ply portions 19 and 20 together — one portion of this "U" pattern being designated by the numeral 28 in FIG. 3.

As just indicated, the second and third ply portions 20 and 21 are advantageously provided as an integral part and are separated by the initial fold line 29. Thus, when the return envelope 15 is installed within the mailer 10, the flap or third ply portion 21 is positioned in face to face relation with the second ply portion 20 — see FIG. 1. In use, the recipient removes the return envelope from the mailer, unfolds the front flap or third ply portion 21 so that it is essentially straight, inserts his check, etc., folds the third ply portion 21 at the line of potential folding 26 and seals the return envelope as represented by the showing in FIG. 3.

The return envelope is increased in length by the dimension between the initial fold line 29 and the line of potential folding 26 on the web constituting the second and third web ply portions 20 and 21. This dimension is limited by the necessity of the remaining portion 25 (from the line of potential folding 26 to the free edge 22) to extend to an overlap to some extent the back ply 19 to which it is to be sealed.

In a commonly used short length mailer of 4¼ inches length, the inside plies are 3½ inches long. By use of the invention, the return envelope unfolded and sealed for return can be 5 inches long and provide a ½ inch overlap for sealing to the back ply. A more conventional (and therefore desirable) length might be 4⅛ inches which is the dimension of the most popular regular envelope size. This would provide an inside useful dimension of 3⅞ inches which is satisfactory for a commercial check which is most commonly 3½ long. It will be immediately appreciated that with interior plies having lengths 3½ inches, it would be impossible to accommodate a commercial size check.

Where the inventive return envelope is made utilizing separate webs for the envelope front and back, it is normally necessary to remove a "chip" or transverse strip from the web ultimately constituting the envelope back 19 as well as the plies 13 and 14. In this case, it is advantageous to provide the initial fold line 29 within the confines of the first ply portion or back 19 so that during manufacture the united second and third ply portions 20 and 21 are not inadvertently clipped out.

Figure 4:
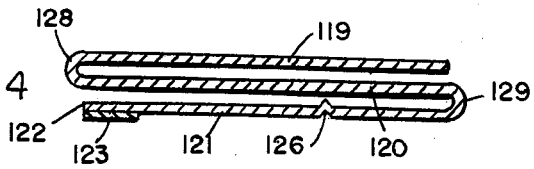
FIGS. 4 and 5 are sectional views of modified forms of return envelope of the invention.

In another version of the invention it is possible to employ the construction where the entire return envelope is formed from one continuous web on-line in the mailer collator. In this case, the web is folded in two places to form the three web ply portions and this is illustrated schematically in FIG. 4. In FIG. 4, like numerals are used for like elements to those used in FIGS. 1–3 and 6–7 but with the addition of 100. Thus, the first ply portion which ultimately forms the back of the return envelope is designated by the numeral 119. The second ply portion which constitutes a part of the envelope front is designated by the numeral 120. However, instead of uniting these ply portions by adhesive as at 28, a fold as at 128 is utilized. However, adhesive (not shown) is provided along the two longitudinal edges of the plies 19 and 20 form an envelope pocket.

As before, the return envelope has a fold line as at 129 separating the second ply portion 20 from the third portion 121. Further, as before, the third ply portion includes a line of potential folding as at 126 and is equipped with adhesive as at 123 adjacent the free edge 122.

Figure 5:
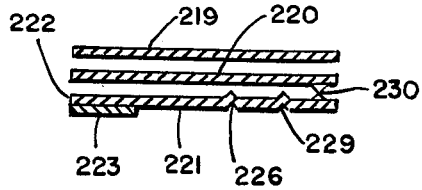

A further variation can be seen in FIG. 5 which includes essentially three discrete plies or panels forming the return envelope. The ply or part 219 constitutes the envelope back while the ply 220 constitutes a portion of the envelope front. The bottom most ply (as seen in FIG. 5) is designated 221 and provides the remaining part of the front of the return envelope as well as the flap. The free edge of this ply 221 is designated 222 and the flap portion is seen to be equipped with the usual adhesive 223. In contrast to the embodiments of the invention previously illustrated, the form depicted in FIG. 5 has the plies 220 and 221 provided separately — which may be of a size equivalent to the other interior information plies 13 and 14 (see FIG. 1). The plies 220 and 221 are united along corresponding edges by means of a band of adhesive 230.

Figure 6:
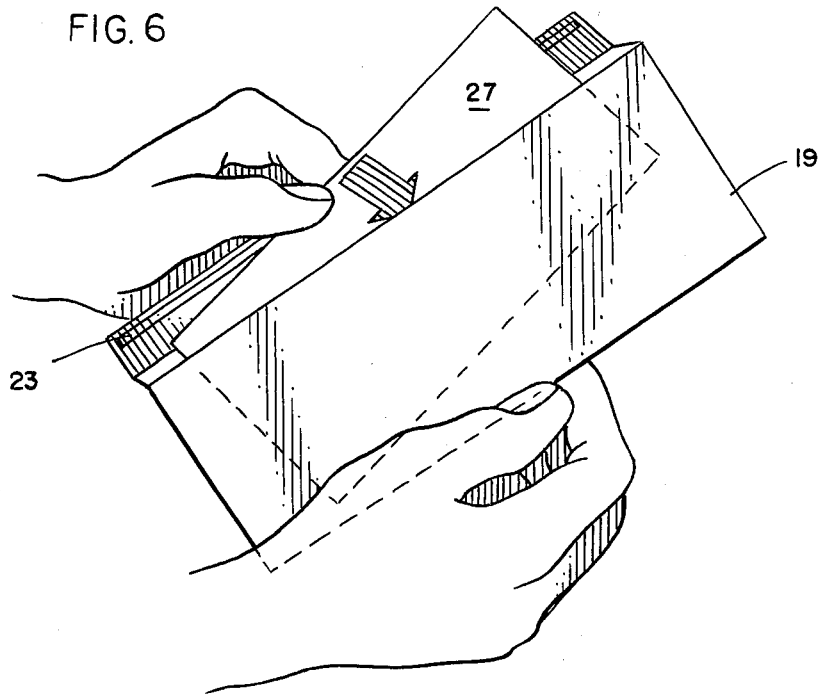
FIGS. 6 and 7 are perspective views showing steps employed in placing a check within the envelope.
Figure 7:
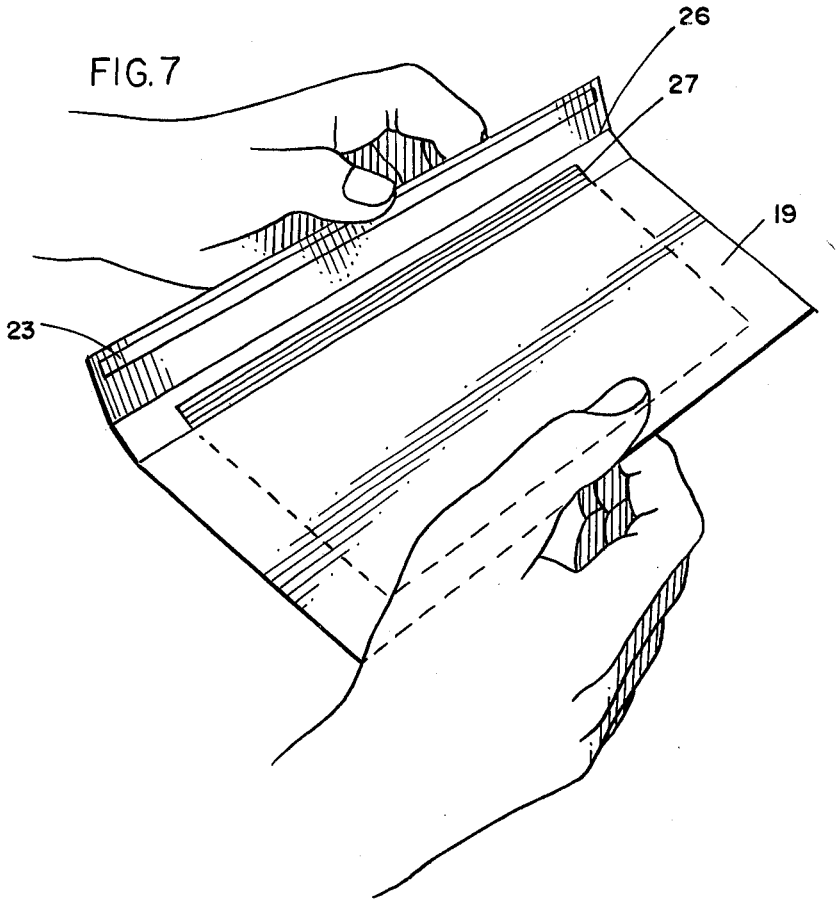

In the operation of the embodiment of FIG. 5, the envelope is first manipulated to extend the ply 221 generally parallel to and as an extension of the ply 220 — much the same as is illustrated in FIGS. 6–7. For this purpose, the ply 221 is advantageously folded along the line of potential folding 229. The line of potential folding 229 may either be a score line productive of an ultimate fold, a perforation or merely a print line or the like indicating the desirability of initially folding at that position. After the material to be returned has been inserted into the envelope, the ply 221 is folded in the fashion as previously explained — along the line of potential folding 226.

As indicated previously, the invention finds particular advantage in the relatively short "length" mailers, i.e., those less than 5½ inches in the web direction. Thus, a 5 inch long mailer could constitute the largest mailer in which the invention is most advantageously employable. On the other hand, mailers shorter than 3½ inches in length, as currently employed, do not lend themselves particularly for inclusion of envelopes that are conveniently handled by the postal authorities. Irrespective of the size of mailer, i.e., 3½ inches or 5 inches length, a certain amount of the ply 21 has to be used to support the band of adhesive 23. Normally, this will be of the order of ⅜ inches. Assuming ⅜ inches overlap of the ply 21 relative to the back ply 19, and further assuming that the ply 21 has the maximum available length of 4¼ inches, this results in the front of the envelope being increased 1 15/16 inches.

On the other hand, with the 3½ inches outside length mailer, the inside ply length, i.e., the length of the plies 13, 14, etc. is 2¾ inches. Assuming the same amount of space occupied by the flap adhesive 23 (⅜ inches) the remainder of the front (or more properly the increase in length of the front) is 1 3/16 inches. This is approximately 43% of the length of the interior plies. In the illustration just given with respect to the 5 inches nominal length mailer, the front length can be increased up to about 45%. The actual increase in length of the front panel of the envelope may be dictated by intented usage and other practical parameters.

While in the foregoing specification, a detailed description of the invention has been set down for the purpose of illustration, many variations in the details hereingiven may be made by those skilled in the art without departing from the spirit and scope of the invention.

I claim:

1. In combination, a series of connected stuffed, sealed envelope assemblies separated by transverse lines of perforation, each assembly having a top and bottom ply and a plurality of smaller intermediate plies, each assembly having a predetermined interior dimension extending perpendicular to said lines of perforation, certain of said intermediate plies constituting a return envelope, each return envelope comprising: a generally rectangular first ply portion forming the return envelope back, a generally rectangular second ply portion forming only a part of the return envelope front and united to said first ply portion along three sides to provide an envelope pocket, a generally rectangular third ply portion forming the remaining part of said return envelope front and also the flap of said return envelope, said flap being equipped with adhesive for securing the same to said return envelope back, means connecting said second and third ply portions with said third ply portion overlying said second ply portion when said return envelope is in a first condition as part of a mailer, and a line of potential folding in said third ply portion between said remaining front part of said flap to permit said return envelope to be folded along said line of potential folding wherein said flap contacts said envelope back for said envelope to assume a second condition wherein it is adapted to confine a check or the like larger than said return envelope back, said flap being larger than said remaining front part, the cumulative dimension of said second ply portion and said remaining front part extending perpendicular to said lines of perforation being at least as great as said interior dimension.

2. The structure of claim 1 in which said first ply portion is separate from said second and third ply portions and is adhesively united to said second ply portion along said three sides.

3. The structure of claim 1 in which said connecting means includes a fold line, said second and third portions being integral with each other.

4. The structure of claim 3 in which said fold line overlies said first ply portion.

5. The structure of claim 1 in which said connecting means includes a band of adhesive.

6. The structure of claim 1 in which said first ply portion is integral with said second and third ply portions and is adhesively united to said second ply portion along two of said three sides, the union of said first and second ply portions along the third of said three sides including a line of folding.

7. In combination, a series of connected stuffed, sealed envelope assemblies separated by transverse lines of perforation each assembly having a top and bottom ply and a plurality of smaller intermediate plies, each assembly having a predetermined interior dimension extending perpendicularly to said lines of perforation certain of said intermediate plies constituting a return envelope, each return envelope comprising: a first ply portion forming the return envelope back, a second ply portion forming part of the front of the return envelope, a third ply portion forming the remainder of the front of the return envelope and the return envelope flap, at least said second and third ply portions being integral and having a fold line therebetween with said third ply portion being reversely folded relative to said second ply portion and being in face-to-face contacting relation with said second ply portion when said return envelope is in a first condition as part of said assembly, and first and second ply portions being united to provide a pocket having a mouth adjacent said fold line, and a line of potential folding in said third ply portion parallel to said fold line and positioned between said flap and said remainder of the return envelope front, said flap being larger than the remainder of said return envelope front and the cumulative dimension of said second ply portion and said remaining front part extending perpendicular to said lines of perforation being at least as great as said interior dimension whereby said third ply portion is adapted to be folded along said line of potential folding to dispose said envelope in a second condition for mailing of a check or the like larger than said return envelope back.

8. The structure of claim 7 in which said first and second ply portions are separate webs, said fold line overlying said first ply portion.

9. The structure of claim 7 in which said first and second ply portions are integral.

* * * * *